US006926061B2

(12) United States Patent
Schulte

(10) Patent No.: US 6,926,061 B2
(45) Date of Patent: Aug. 9, 2005

(54) CABLE TENSIONER AND SHOCK ABSORBER FOR A DOOR

(75) Inventor: Peter S. Schulte, East Dubuque, IL (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 10/389,371

(22) Filed: Mar. 14, 2003

(65) Prior Publication Data

US 2003/0178158 A1 Sep. 25, 2003

Related U.S. Application Data

(63) Continuation-in-part of application No. 09/947,616, filed on Sep. 6, 2001, now abandoned.

(51) Int. Cl.[7] ..... E05F 15/00
(52) U.S. Cl. ..... 160/191; 160/193; 49/200
(58) Field of Search ..... 160/193, 192, 160/191, 190, 189, 322, 405; 49/197, 199, 200, 445

(56) References Cited

U.S. PATENT DOCUMENTS

| | | | | |
|---|---|---|---|---|
| 1,896,263 | A | | 1/1933 | Backes |
| 2,033,893 | A | | 3/1936 | White |
| 2,092,531 | A | * | 9/1937 | Dimick ..... 16/84 |
| 2,097,950 | A | | 11/1937 | Johnson |
| 2,953,928 | A | | 9/1960 | Anderson et al. |
| 3,094,163 | A | | 6/1963 | Herber |
| 3,412,780 | A | | 11/1968 | Moler |
| 3,460,602 | A | | 8/1969 | Hugus |
| 3,981,343 | A | | 9/1976 | DeVito |
| 4,252,172 | A | | 2/1981 | Pommat et al. |
| 4,800,946 | A | | 1/1989 | Rosenoy |
| 4,887,658 | A | | 12/1989 | Cloutier |
| 4,887,659 | A | | 12/1989 | West |
| 4,997,022 | A | | 3/1991 | Klein |
| 5,129,442 | A | | 7/1992 | Warner |
| 5,259,433 | A | | 11/1993 | Cloutier |
| 5,271,183 | A | | 12/1993 | Hahn et al. |
| 5,353,859 | A | | 10/1994 | Oltahfer et al. |
| 5,392,836 | A | | 2/1995 | West et al. |
| 5,558,147 | A | | 9/1996 | Nofziger |
| 5,655,591 | A | | 8/1997 | Knutson |
| 5,730,197 | A | | 3/1998 | Schwingle |
| 5,743,046 | A | | 4/1998 | Siegler et al. |
| 5,803,149 | A | | 9/1998 | Halley et al. |
| 5,887,385 | A | | 3/1999 | Horner et al. |
| 6,164,014 | A | | 12/2000 | McDowell et al. |
| 6,263,947 | B1 | | 7/2001 | Mullet |
| 6,311,757 | B1 | | 11/2001 | Schuette et al. |
| 6,326,751 | B1 | | 12/2001 | Mullet et al. |

FOREIGN PATENT DOCUMENTS

| | | |
|---|---|---|
| GB | 1527046 | 10/1978 |
| WO | WO 90-03486 | 4/1990 |

* cited by examiner

*Primary Examiner*—David Purol
(74) *Attorney, Agent, or Firm*—Hanley, Flight & Zimmerman, LLC.

(57) ABSTRACT

A cable tensioner for an industrial door helps keep a cable neatly wrapped on its take-up drum. In some embodiments, the tensioner functions in a first mode during normal door operation, and operates in a second mode when the tension in the cable decreases to a predetermined low level. When operating in the second mode, the tensioner is able to take up slack in a cable that supports a door member, such as a door panel or a deadweight that counteracts the door panel's weight. The tensioner includes a shock absorber that resists a reaction force pulling on the tensioner when the tensioner is in the second mode. The tensioner may be adapted for use on various doors including, but not limited to, sectional doors, roll-up doors, high-lift doors, horizontally storing doors, vertically storing doors, and various combinations thereof.

16 Claims, 18 Drawing Sheets

CABLE TENSIONER AND SHOCK ABSORBER FOR A DOOR

CROSS-REFERENCE TO RELATED APPLICATION

This application is a continuation-in-part application of U.S. application Ser. No. 09/947,616, filed on Sep. 6, 2001 now abandoned.

BACKGROUND OF THE INVENTION

1. Field of the Invention

The subject invention generally pertains to industrials doors and more specifically to a cable tensioner for such a door.

2. Description of Related Art

Sectional doors and rollup doors are two common examples of an industrial door. Sectional doors are often used as residential garage doors; however, they are also often used in warehouses and other industrial buildings. A sectional door typically includes a series of panels whose adjacent horizontal edges are connected by hinges. As the door opens or closes, the door panels travel along two lateral tracks. The tracks typically include a vertical section and an overhead section with a transitional curved section between the two. To close the door, the tracks guide the panels to a vertical position across the doorway. When the door opens, the hinges allow at least some of the panels to curve around onto the overhead section of the tracks. Such doors can be powered open and closed or moved manually.

To fit a sectional door underneath a standard 8-foot high ceiling of a typical residential garage, the vertical section of tracks is of limited height and the overhead section of tracks is generally horizontal. However, to take full advantage of generally higher ceilings in warehouses and other industrial buildings, a certain types of sectional doors known as a "high-lift" or "vertical lift" may be used. With a vertical-lift sectional door, the vertical section of tracks is extended and the overhead section may be nearly vertical or lie at an incline, such as a 15-degree incline from horizontal. The nearly vertical or inclined overhead section plus the extra vertical section provides greater clearance for material handling equipment, parts, and other equipment that may need to pass underneath the overhead tracks. With high-lift doors, one or more panels may store in the vertical and/or curved section of tracks when the door is at its fully open position.

A roll-up door typically includes a pliable roll-up panel or curtain that is wound about an overhead roller. Some roll-up panels are made of flexible fabric reinforced with several vertically spaced horizontal stays or wind bars. Other roll-up panels comprise a series of narrow, relatively rigid metal bars or segments that extend horizontally across the doorway. The segments are pivotally interconnected along their horizontal edges, so that the panel can wrap around the overhead roller.

To close a roll-up door, the roller pays out the panel as two vertical tracks along either side edge of the doorway guide the side edges of the panel generally along a vertical plane across the doorway. The rotation of the roller is reversed to open the door. Roll-up doors are typically either powered open and closed, or are powered open and allowed to close by gravity.

To ease the operation of a vertically moving door, a counterbalance system is often used to counteract the weight of the door panel or panels. Counterbalance systems typically include one or more deadweights or a spring. When deadweights are used, they are usually suspended from a cable that is wrapped about a drum fixed to an overhead rotatable shaft. Another drum fixed to that same shaft holds another cable that carries the weight of the door panels. The cable attached to the door panels and the cable attached to the deadweights are wrapped about their respective drums in opposite directions to create two opposing torques that are applied to the overhead shaft. With the two torques acting in opposite directions, the weights of the door panels and the deadweights generally cancel each other, which makes it easier to open and close the door. Doors with a counterbalance system employing a torsion spring operate in a similar manner; however, the torsion spring applies a torque to the overhead shaft that replaces the torque otherwise created by the cable-suspended deadweight.

To keep a cable neatly wrapped about its drum and to prevent the cable from getting tangled by overlapping itself, a drum may include a cable groove that runs helically around the drum. The groove creates a helical track that helps guide the cable in a similar helical pattern as the cable wraps and unwraps about the drum. This works well as long as the cable is maintained in sufficient tension. Under certain circumstances, however, the tension in a cable may be momentarily released, which can create sufficient slack in the cable to allow the cable to "jump a groove" and get tangled with itself on the drum. This can damage a cable, cause a door to jerk unexpectedly, or even prevent operation of the door until maintenance personnel corrects the problem. In severe cases, the cable may even jump completely off the drum.

There are many situations, some of which may be unknown, which can cause a momentary release of cable tension. When opening a door, for example, momentum may carry the door panel beyond its normal open position. This may momentarily unload the door's counterbalance system by lowering a deadweight onto the floor or by releasing the preload on a counterbalance's torsion spring. Or if a door is slammed shut, the door panel may come to an abrupt stop upon hitting the floor. Meanwhile, the angular momentum of the overhead shaft may allow the drum that supports the door panel to continue releasing cable. At the same time, the upward momentum of a deadweight may allow the deadweight to continue traveling upward, which could release the tension in the deadweight's cable as well. A cable can also become slack if whatever it is carrying (door panel or deadweight) gets snagged or caught upon traveling downward. In general, the cable that supports either the door panel or a deadweight may become slack and jump a groove whenever the relative speed or position of the deadweight and the door panel is mismatched.

These slack conditions typically occur from the deadweight hitting a ground surface during the raising of the door panel. For conditions where the door is rapidly raised, the door panel may overshoot its raised position, after the deadweight has hit the ground. Depending on the size and weight of the door, and the rapidity of the ascent, the door panel may rapidly freefall, imparting a high pulling force (i.e., a shock) on the cable. This shock condition can cause great strain on the cable, especially on cables that are quickly jerked from a slack condition to fully taught, by this downward freefall. Shock also occurs on cables traveling in the reverse direction, i.e., when the door is lowered. The deadweight and may overshoot it's fully raised position, when a rapidly descending door hits the ground. The deadweight may freefall from this overshoot condition and impart a shock force on the cable.

SUMMARY OF THE INVENTION

In some embodiments, a door includes a door panel, a counterbalance system including a flexible elongated member, and a tensioner coupled to the counterbalance system and adapted to apply a tensioning force to prevent slack in the flexible elongated member. The tensioner includes a shock absorber coupled to the counterbalance system to absorb a reaction force greater than the tensioning force.

In some embodiments, the shock absorber includes a first resilient member that is a tension spring.

In some embodiments, the shock absorber includes a first resilient member that is a compression spring.

In some embodiments, the shock absorber includes a first resilient member that is a torsion spring.

In some embodiments, the tensioner includes a second resilient member, and the first resilient member is more resilient than the second resilient member.

In some embodiments, the first resilient member is moveable relative to the second resilient member.

In some embodiments, the shock absorber has sufficient resiliency to absorb an amount of the reaction force above a predetermined amount.

In some embodiments, the tensioner includes a resilient member that is a tension spring.

In some embodiments, the tensioner includes a resilient member that is a compression spring.

In some embodiments, the tensioner includes a resilient member that is a torsion spring.

In another embodiment, a method of counterbalancing a door includes providing a door panel that is movable between a first position to a second position; coupling a flexible elongated member to the door panel; coupling a deadweight to the flexible elongated member so that the deadweight moves downward in response to the door panel moving from the first position to the second position; applying a tensioning force to prevent slack in the flexible elongated member; and in response to a reaction force overcoming the tensioning force, countering the reaction force to prevent a predetermine amount of force from transferring to the flexible elongated member.

DESCRIPTION OF THE PREFERRED EMBODIMENT

Figure 1:
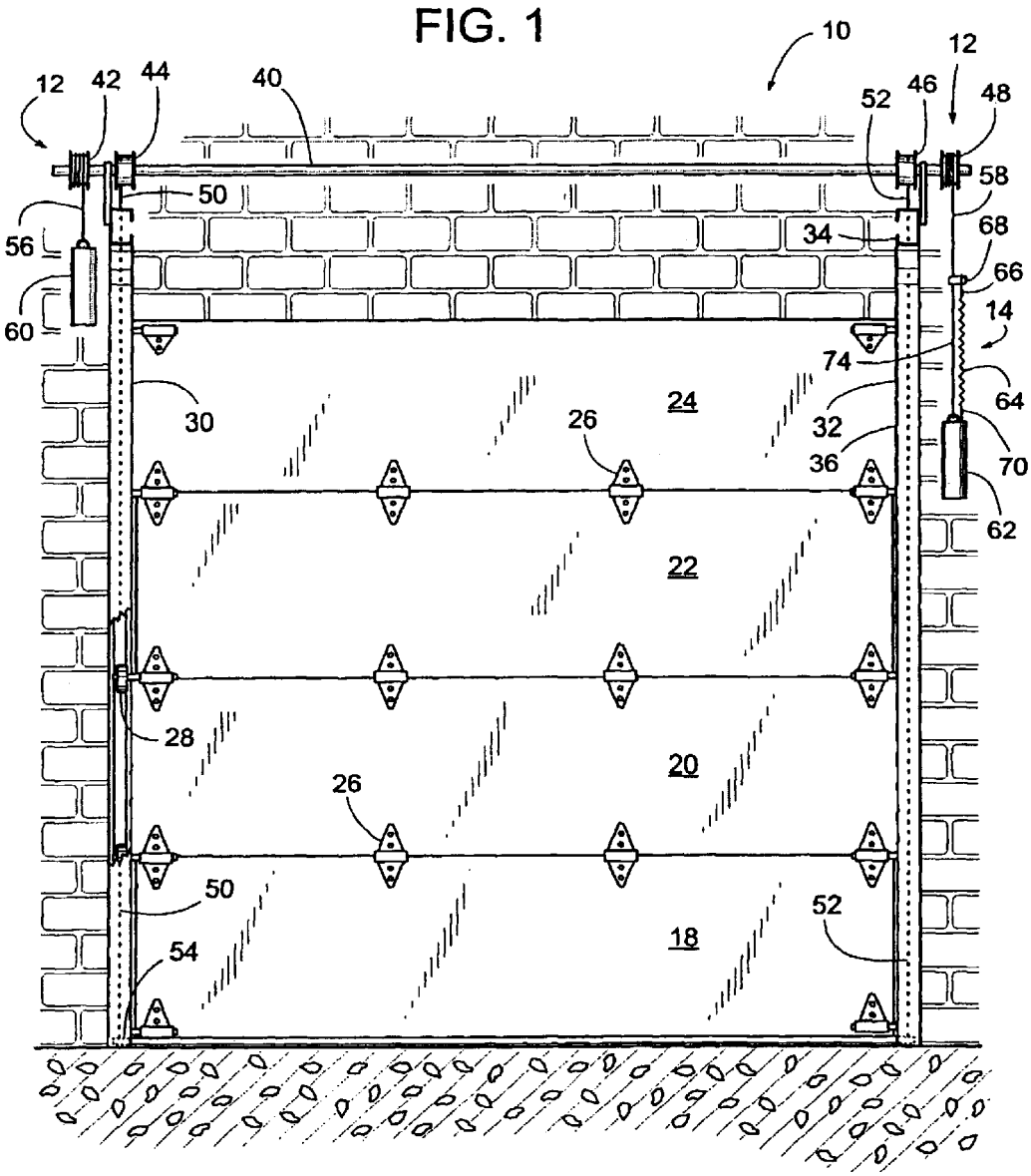
FIG. 1 is a front view of a sectional door in a closed position, as viewed from inside a building, and showing a tensioner coupled to the door's counterbalance system.
Figure 2:
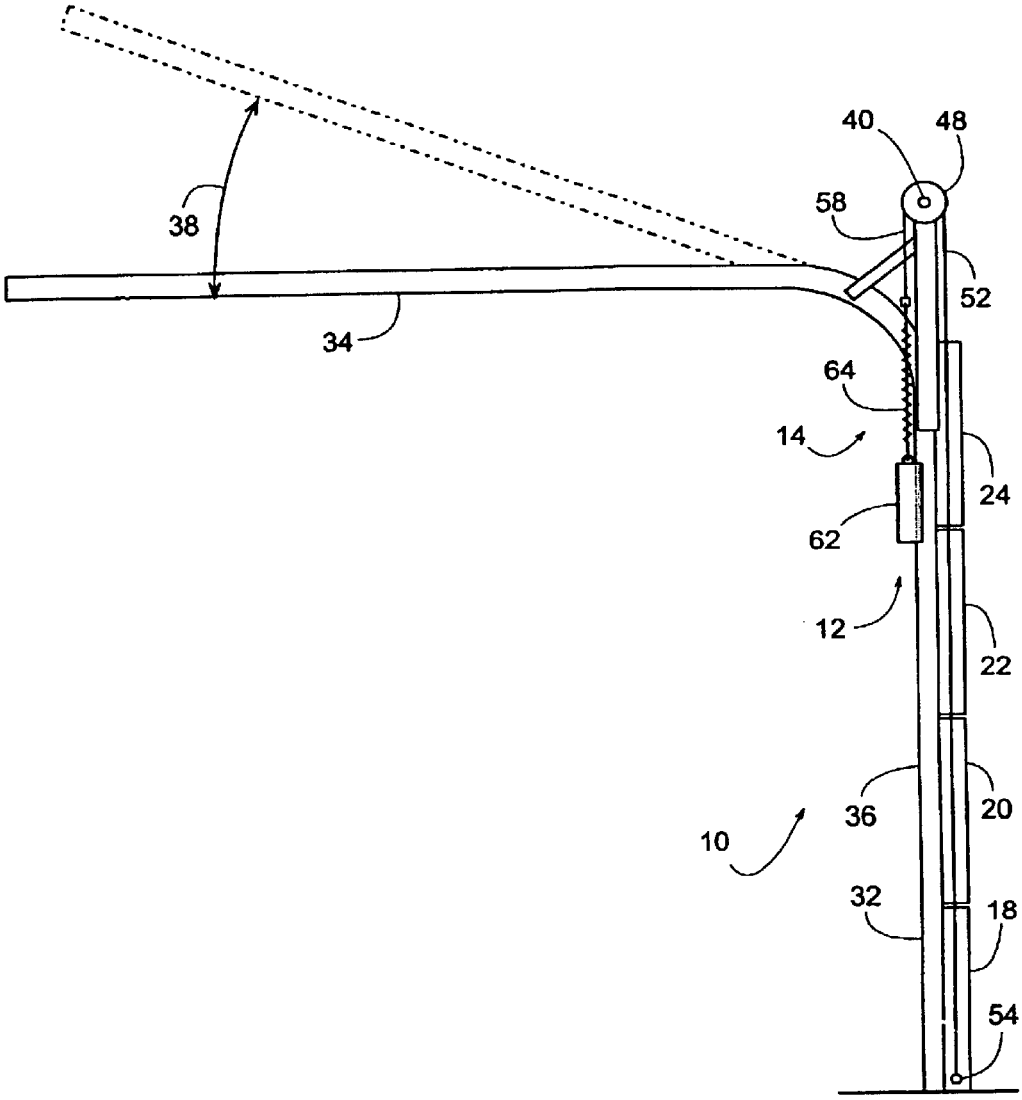
FIG. 2 is a right side view of FIG. 1.
Figure 3:
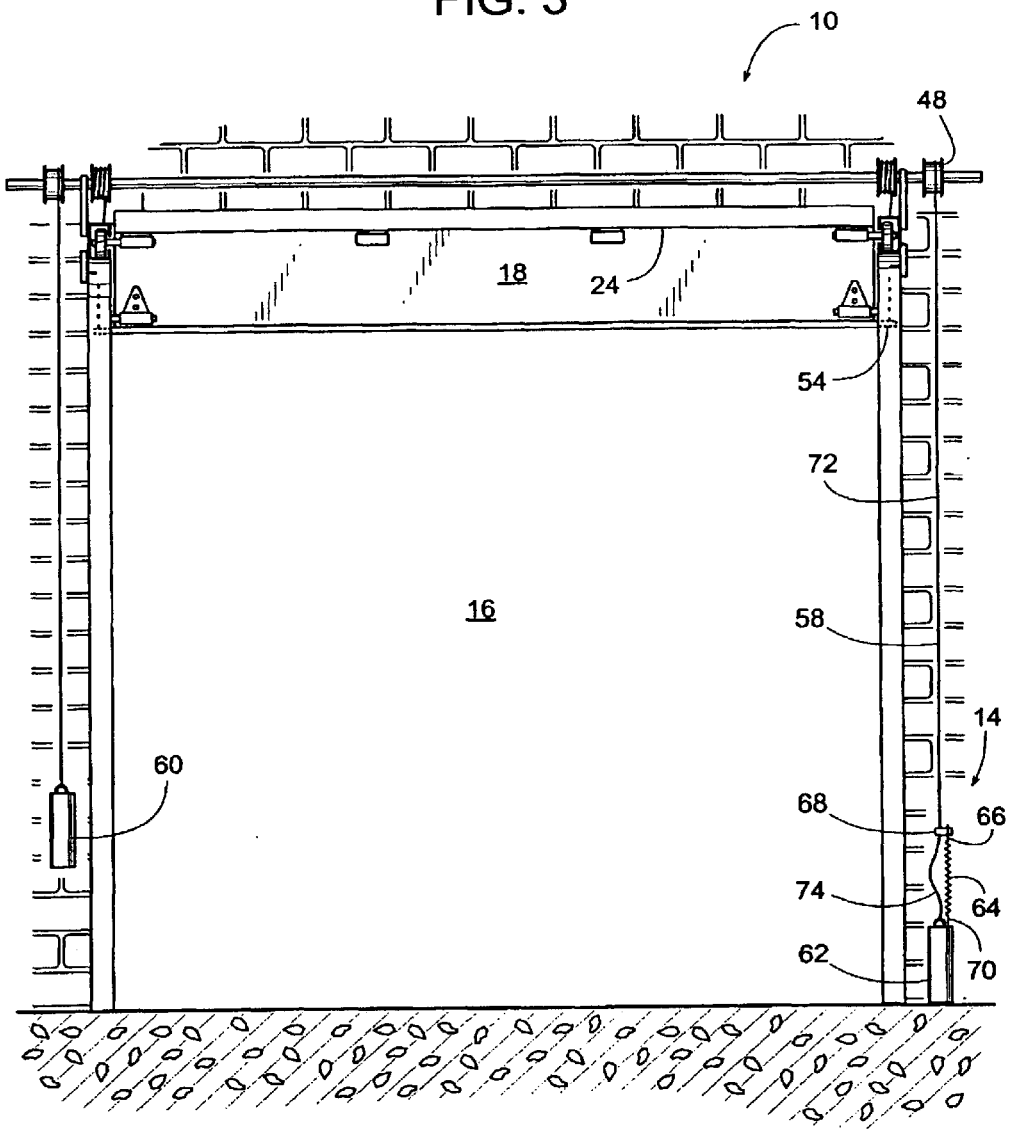
FIG. 3 is the similar to FIG. 1, but with the door open.
Figure 4:
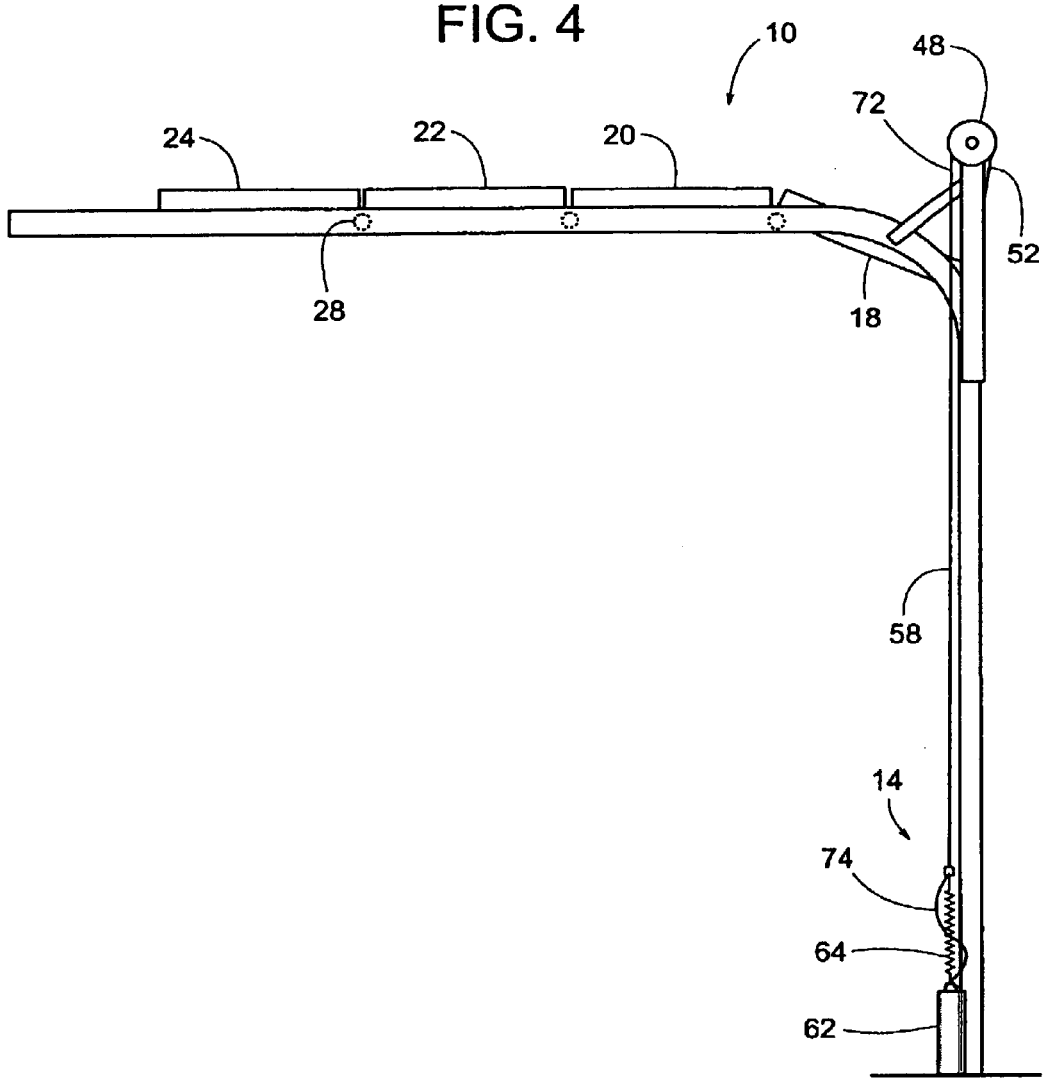
FIG. 4 is a right side view of FIG. 3.

A sectional door 10, shown closed in FIGS. 1 and 2 and open in FIGS. 3 and 4, is just one example of a vertically moveable door. Door 10 includes a counterbalance system 12 that helps counterbalance at least some of the weight of the door's door panels. Door 10 also includes a tensioner 14 that helps maintain various flexible elongated members of counterbalance system 12 taut during certain operating conditions. The term, "counterbalance system" refers to any apparatus that includes a deadweight or a spring (e.g., torsion spring) working in conjunction with a flexible elongated member (e.g., a cable, chain, strap, cord, rope, etc.) for carrying or countering at least some of the weight of a door's panel as the door moves between its open and closed positions. The term, "door panel" refers to any member that is moveable to selectively cover and uncover at least part of a doorway opening (e.g., doorway 16). A door panel may be a generally rigid, planar member or a pliable sheet and may be a unitary piece or comprise a plurality of interconnected panel segments.

For the embodiment of FIGS. 1–4, door 10 includes a series of door panels 18, 20, 22 and 24 that are interconnected along their adjacent horizontal edges by hinges 26. As door 10 opens or closes, guide members, such as rollers 28, guide the movement of the panels along two lateral tracks 30 and 32, which curve between upper and lower sections 34 and 36 respectively. In this example, upper section 34 is horizontal, as shown in FIG. 2. In other embodiments, however, upper section 34 may be at any angle 38 ranging from zero-degrees (horizontal) to 90-degrees (vertical). To close door 10, the lower track sections 36 guide the door panels to a vertical position across doorway 16. When door 10 opens, hinges 26 allow the panels to curve around onto upper track section 34, where the door panels store overhead. Door 10 can be power operated or open and closed manually.

To reduce the force required to lift the door panels to their open position, counterbalance system 12 comprises a rotatable shaft 40 to which four drums 42, 44, 46 and 48 are fixed. Two cables 50 and 52, or some other type of flexible elongated member, are wrapped around and fastened to drums 44 and 46 respectively. The lower ends of cables 50 and 52 are coupled to door panel 18 by way of an anchor 54 or some type of fastener. Another pair of flexible elongated members, such as cables 56 and 58 are wrapped around and fastened to drums 42 and 48 respectively. Deadweights 60 and 62 are suspended from the lower ends of cables 56 and 58. Cables 56 and 58 wrap around drums 42 and 48 in a direction opposite to that which cables 50 and 52 wrap around drums 44 and 46. As door 10 is moved between its open and closed positions, deadweights 60 and 62 hanging from cables 56 and 58, and door panels 18, 20, 22 and 24 hanging from cables 50 and 52 create two opposing torques that are applied to shaft 40. With the two torques acting in opposite directions, the weight of the door panels and deadweights help cancel each other, which makes it easier to open and close the door. Depending on the relative weight of the deadweights and the door panels, door 10 may not necessarily be perfectly balanced, but instead the door may be biased open or closed.

As door 10 opens, the door panels sequentially move onto the upper section of tracks 34, which help support the weight of those panels. This relieves some of the tension in cables 50 and 52. To reduce the counter tension in cables 56 and 58 accordingly, deadweight 62 may be lowered down onto the floor, as shown in FIGS. 3 and 4. This occurs automatically, as deadweight 62 is lower than deadweight 60. As deadweight 62 reaches the floor, cable 58 may become slack.

To prevent the cable slackness from allowing cable 58 to lift off of drum 48, tensioner 14 is coupled to cable 58 between deadweight 62 and drum 48 to maintain an acceptable amount of tension in cable 58. In this particular embodiment, tensioner 14 comprises a resilient member, such as a tension spring 64. An upper end 66 of spring 64 attaches to cable 58 by way of a cable clamp 68 or some other type of fastener, and a lower end 70 of spring 64 attaches to deadweight 62. Spring 64 is stretched (i.e., prestressed) by deadweight 62 hanging from cable 58, as shown in FIGS. 1 and 2. As the weight of deadweight 62 is unloaded from cable 58, as shown in FIGS. 3 and 4, spring 64 retracts to maintain a certain amount of tension in an upper portion 72 of cable 58, while only a lower portion 74 of cable 58 becomes slack. The tension that spring 64 creates in cable 58 is above a threshold level sufficient to help hold cable 58 snugly against drum 48. Tension spring 64 operates in a first mode (the length of spring 64 remains constant) when the dynamic load in cable 58 is above the predetermined load, as shown in FIGS. 1 and 2. Tension spring 64 operates in a second mode (the spring retracts) when the tension (or dynamic load) in cable 58 is below a predetermined load (e.g., three pounds), as shown in FIGS. 3 and 4.

Figure 5:
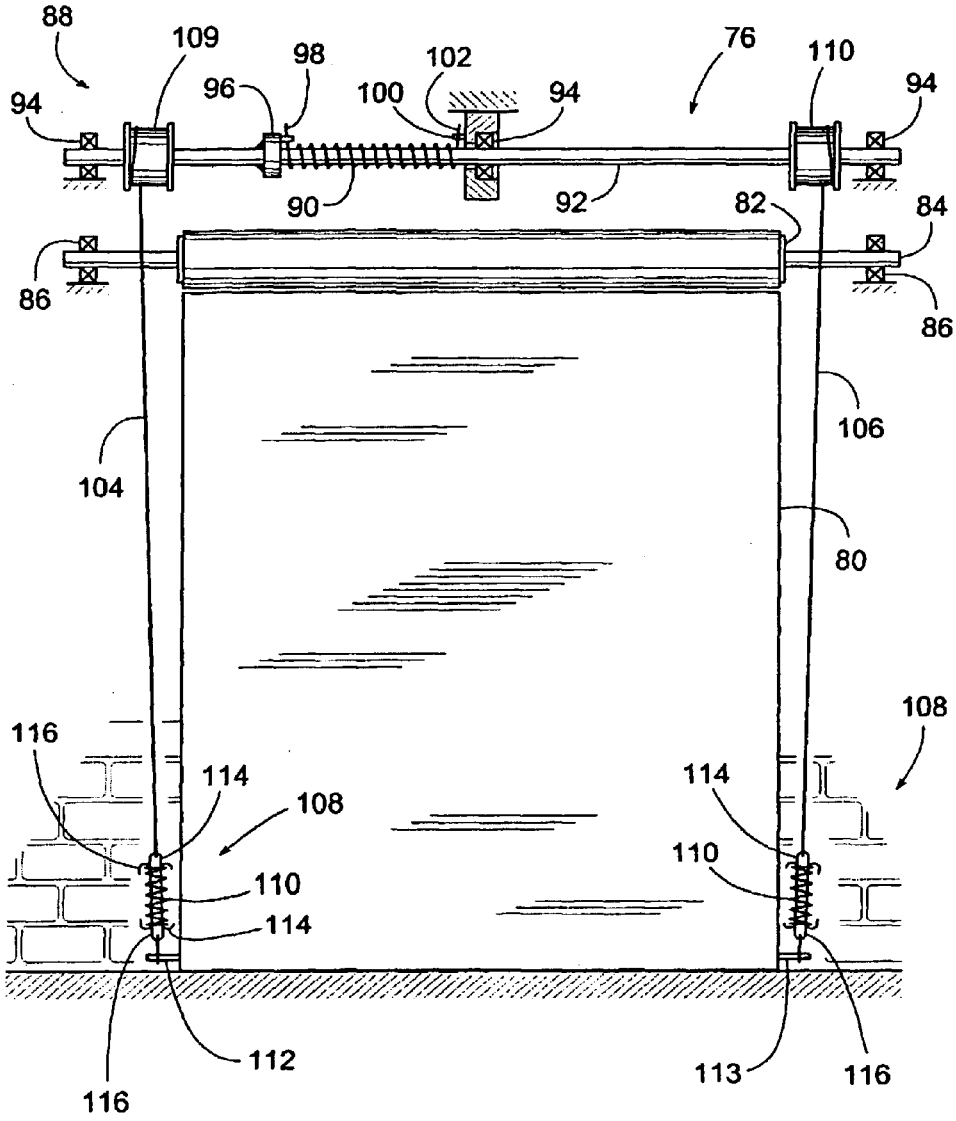
FIG. 5 is a front view of a rollup door in a closed position, as viewed from inside a building, and showing a tensioner coupled to the door's counterbalance system.
Figure 6:
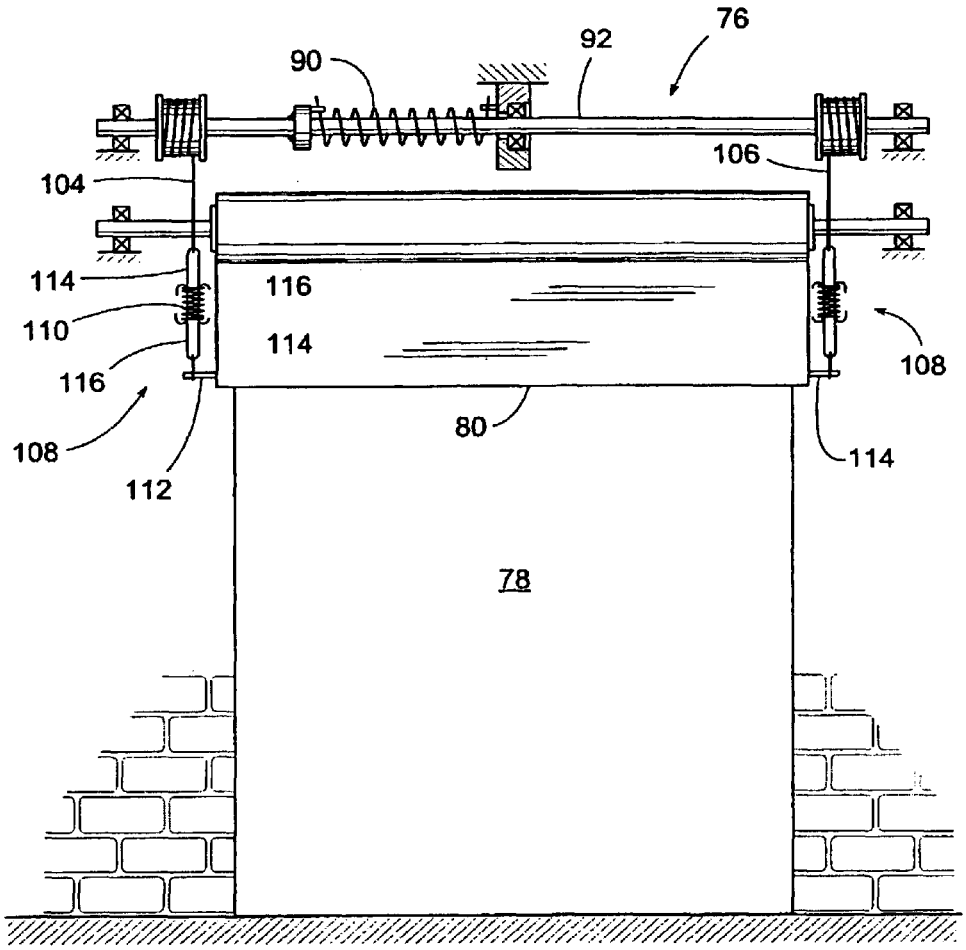
FIG. 6 is similar to FIG. 5, but with the door open.

In another embodiment, a door 76 for use across a doorway 78 includes a pliable rollup door panel 80 that wraps around a roller 82 upon moving from its closed position of FIG. 5 to its open position of FIG. 6. Roller 82 includes a shaft 84 supported by bearings 86. To counteract the weight of panel 80, a counterbalance system 88 of door 76 includes a torsion spring 90 instead of suspended deadweights. Torsion spring 90 applies a torque to a rotatable shaft 92, which is supported by bearings 94. The torque of spring 90 counteracts the torque that the door panel's weight applies to shaft 92.

Torsion spring 90 is disposed about shaft 92 with a spring retainer 96 holding one end 98 of spring 90 generally fixed to shaft 92, so end 98 rotates with the shaft. Another spring retainer 100 holds an opposite end 102 of spring 90 generally stationary, so the relative rotational displacement of retainers 96 and 100 determines the torque that spring 90 applies to shaft 92.

Door panel 80 creates its torque on shaft 92 by being suspended by cables 104 and 106, whose lower ends are coupled to the bottom edge of panel 80. The upper portion of cables 104 and 106 wrap around and connect to drums 109 and 110, which in turn are fixed to shaft 92. As door 80 moves to its open position, the torque created by the weight of door panel 80 decreases as more of the panel's weight becomes supported by roller 82 rather than by cables 104 and 106. To compensate for the changing tension in cables 104 and 106, torsion spring 90 relaxes or unloads as door 76 opens and tightens as door 76 closes. However, to help hold door 76 at its fully open position, torsion spring 90 may not necessarily relax to a state of zero-preload, but instead preferably maintains a certain amount of preload even when the door is fully open.

To help prevent cables 104 and 106 from becoming slack and entangled on their drums, door 76 is provided with a tensioner 108, such as a drawbar spring. Tensioner 108 provides a function similar to that of tensioner 14 in that they both maintain the tension in a cable above a threshold to help hold the cable against its take-up drum. However, unlike tensioner 14, tensioner 108 transmits the full tension of cables 104 and 106 even when door 76 is at or moving toward its open position. Tensioner 108 couples cables 104 and 106 to anchors 112 and 113, which extend from the lower edge of door panel 80. Tensioner 108 comprises a compression spring 110 contained between two wire frames 114 and 116, which are able to move relative to each other. Wire frames 114 connect to cables 104 and 106, and wire frames 116 connect to anchors 112 and 113. As the tension in cables 104 and 106 increases, wire frames 114 and 116 move apart to compress spring 110. When cables 104 and 106 carry an appreciable amount of the door panel's weight, as shown in FIG. 6, compression spring 110 bottoms out, whereby tensioner 108 operates in the first mode. However, when the bottom edge of panel 80 rests on the floor, as shown in FIG. 5, wire frames 114 and 116 move toward each other to place tensioner 108 in the second mode where compression spring 110 expands to take up slack that would otherwise exist in cables 104 and 106.

Figure 7:
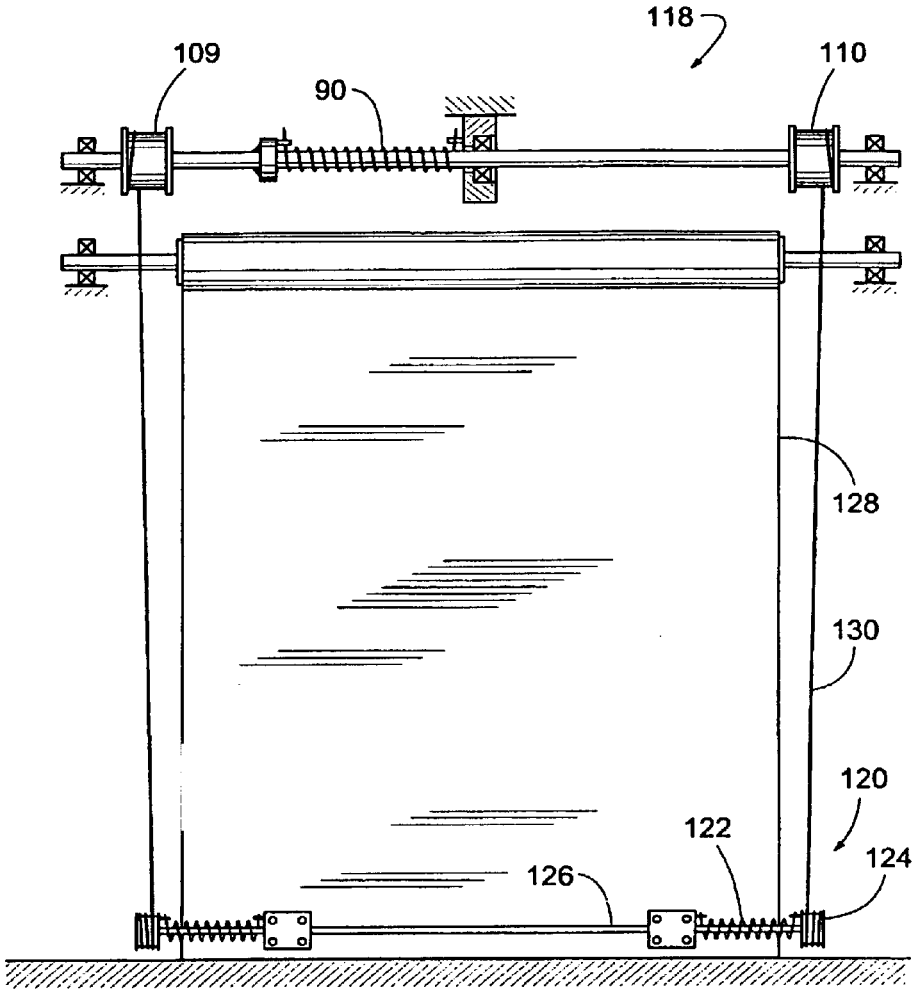
FIG. 7 is a front view of another rollup door in a closed position, as viewed from inside a building, and showing a tensioner coupled to the door's counterbalance system.

In a similar embodiment of a door 118, shown in FIG. 7, a tensioner 120 replaces tensioner 108. In this example, tensioner 120 includes a torsion spring 122 that urges a drum 124 to rotate about a shaft 126 mounted to the lower edge of a rollup door panel 128. The angular rotation of drum 124 is limited (i.e., a sufficient load on a cable 130 rotates drum 124 to a stopping point that places tensioner 120 in its first mode). The limited rotation of drum 124 allows cable 130, whose opposite ends wrap around and connect to drums 124 and 110, to help carry the weight of panel 128 as door 118 opens and closes. When the lower edge of door panel 128 rests on the floor, as shown in FIG. 7, the reduced load on cable 130 allows torsion spring 122 to rotate drum 124 about shaft 126. As drum 124 rotates in this second mode, it takes up the slack in cable 130.

Figure 8:
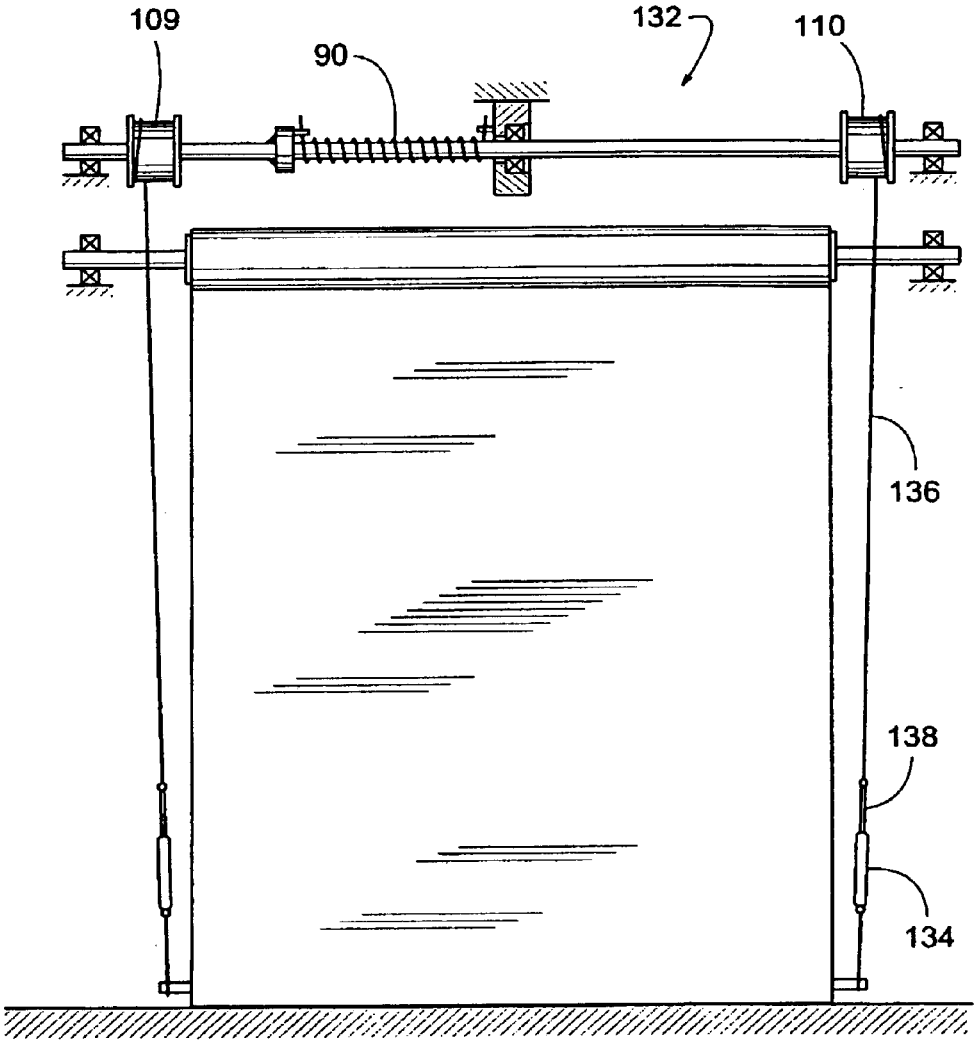
FIG. 8 is a front view of another rollup door in a closed position, as viewed from inside a building, and showing a tensioner coupled to the door's counterbalance system.

FIG. 8 shows a door 132 similar to door 76 of FIGS. 5 and 6; however, a tension-style gas spring 134 (i.e., gas spring 134 includes a normally retracted rod) replaces the drawbar spring of tensioner 108. When the tension in cable 136 decreases to a predetermined level, gas spring 134 retracts its rod 138 in an elastic manner to take up slack in cable 136.

Figure 9:
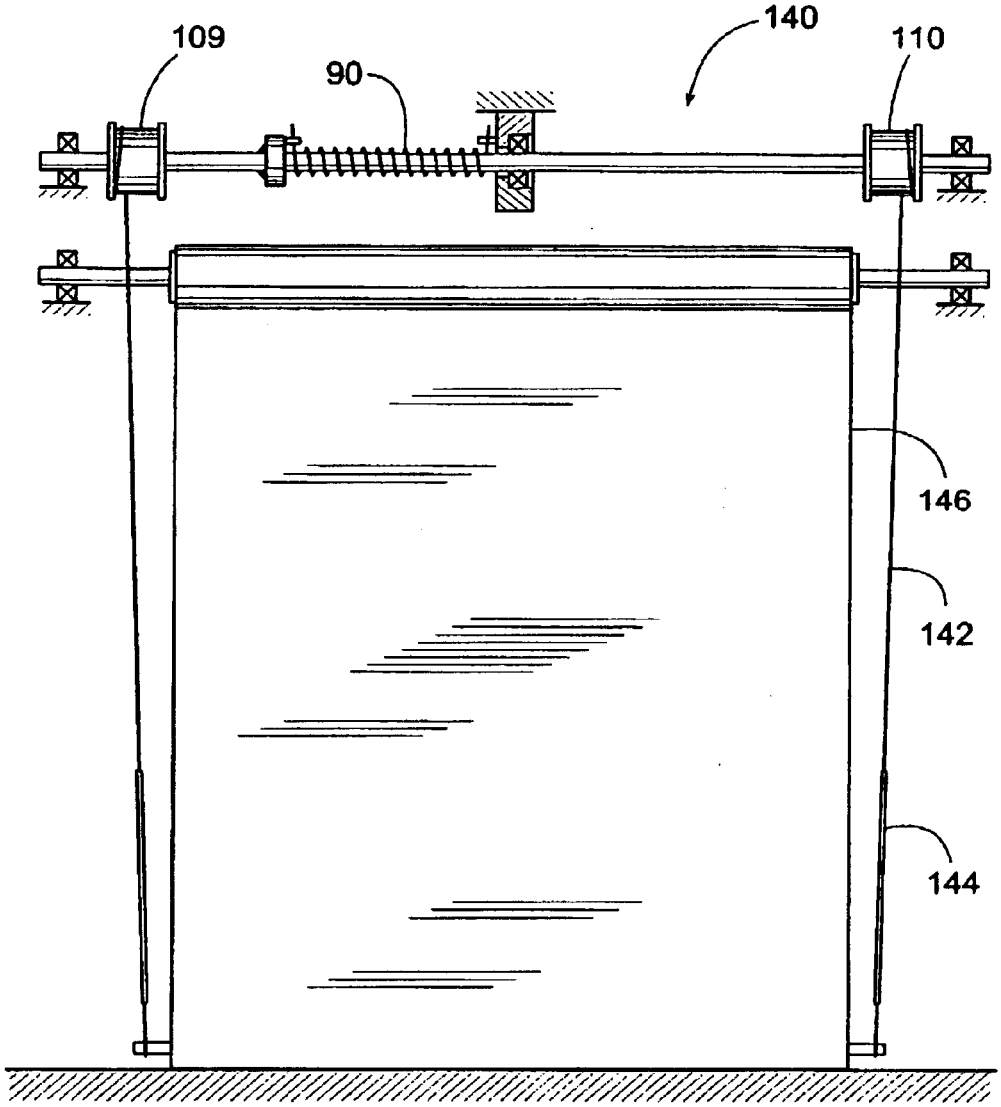
FIG. 9 is a front view of another rollup door in a closed position, as viewed from inside a building, and showing a tensioner coupled to the door's counterbalance system.

FIG. 9 shows yet another door 140 similar to door 76 of FIGS. 5 and 6; however, instead of tensioner 108, a cable 142 comprises an elastic cord 144. Cord 144 operates in its second mode to take up slack in cable 142 when the cable tension (dynamic load) is below a certain level. Above that limit, however, cord 144 reaches its maximum length of stretch and begins functioning as a generally inelastic member (i.e., in its first mode) and is able to help carry the weight of a door panel 146 as door 140 opens and closes.

FIGS. 10–13 illustrate a door 148 similar to door 10 of FIGS. 1–4; however, tensioner 14 of door 10 is replaced by a tensioner 150, which comprises a torsion spring 152 that interacts with drums 154 and 156 of a counterbalance system 158.

To reduce the force required to lift the door panels to their open position, counterbalance system 158 comprises a bracket 161 that supports a rotatable shaft 160 to which three drums 162, 164 and 154 are fixed. A fourth drum 156 is allowed some rotation on shaft 160, but a pin 166 extending from drum 154 and a pin 168 on drum 156 engage each other to limit the rotation of drum 156 relative to drum 154 and shaft 160. The rotation of drum 156 about shaft 160 is limited to just less than 360-degrees due to the thickness of pins 166 and 168. Two cables 170 and 172 are wrapped around and fastened to drums 154 and 156 respectively. The lower ends of cables 170 are coupled to door panel 174 by way of an anchor 176. Another set of cables 172 and 172' are wrapped around and fastened to drums 156 and 162 respectively. Deadweights 62 and 60 are suspended from the lower ends of cables 172 and 172'. Cables 172 and 172' wrap around drums 156 and 162 in a direction opposite to that which cables 170 wrap around drums 154 and 164. As door 148 is moved between its open and closed positions, deadweights 62 and 60 hanging from cables 172 and 172', and the door panels hanging from cables 170 create two opposing torques that are applied to shaft 160. With the two torques acting in opposite directions, the weight of the door panels and deadweights help cancel each other, which makes it easier to open and close the door.

Figure 10:
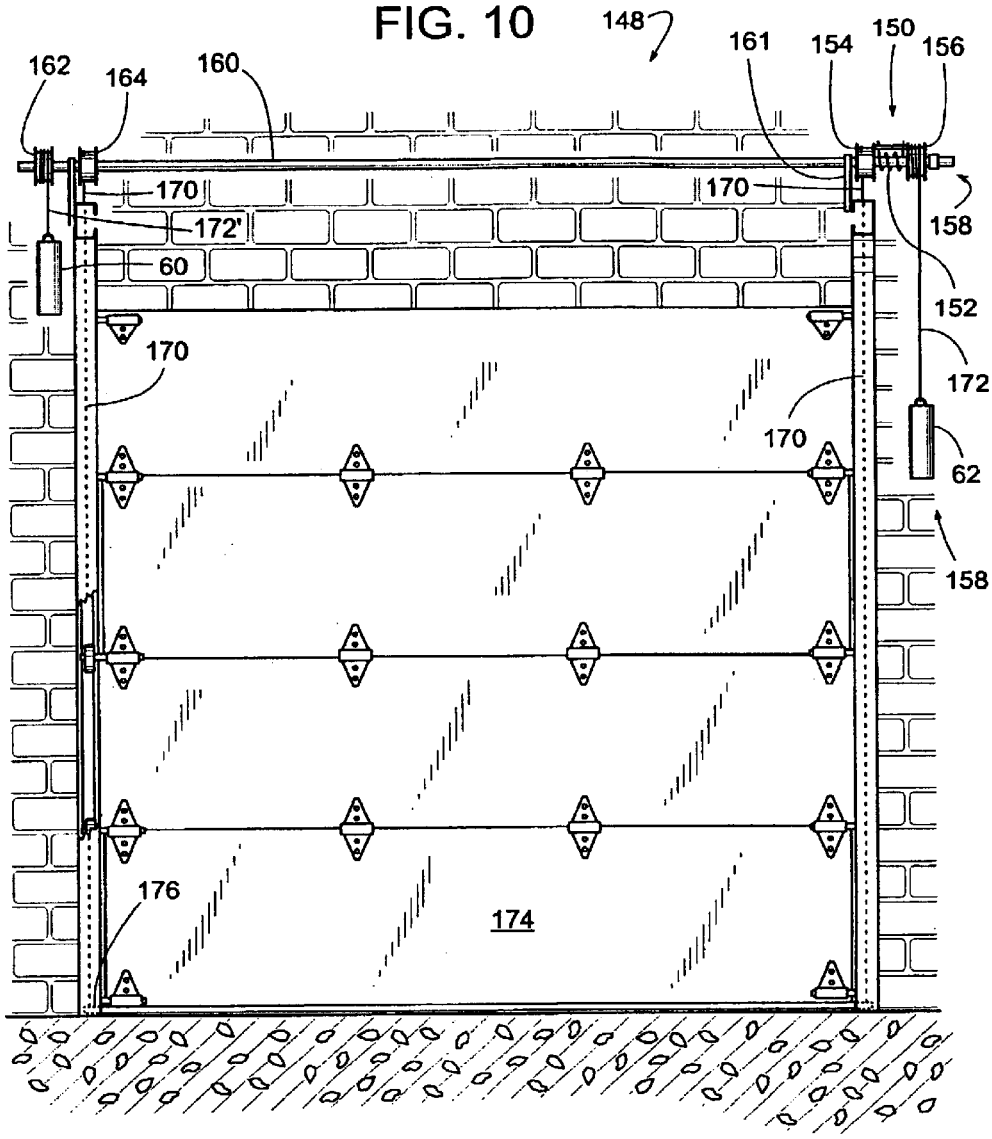
FIG. 10 is a front view of another sectional door in a closed position, as viewed from inside a building, and showing a tensioner coupled to the door's counterbalance system.
Figure 11:
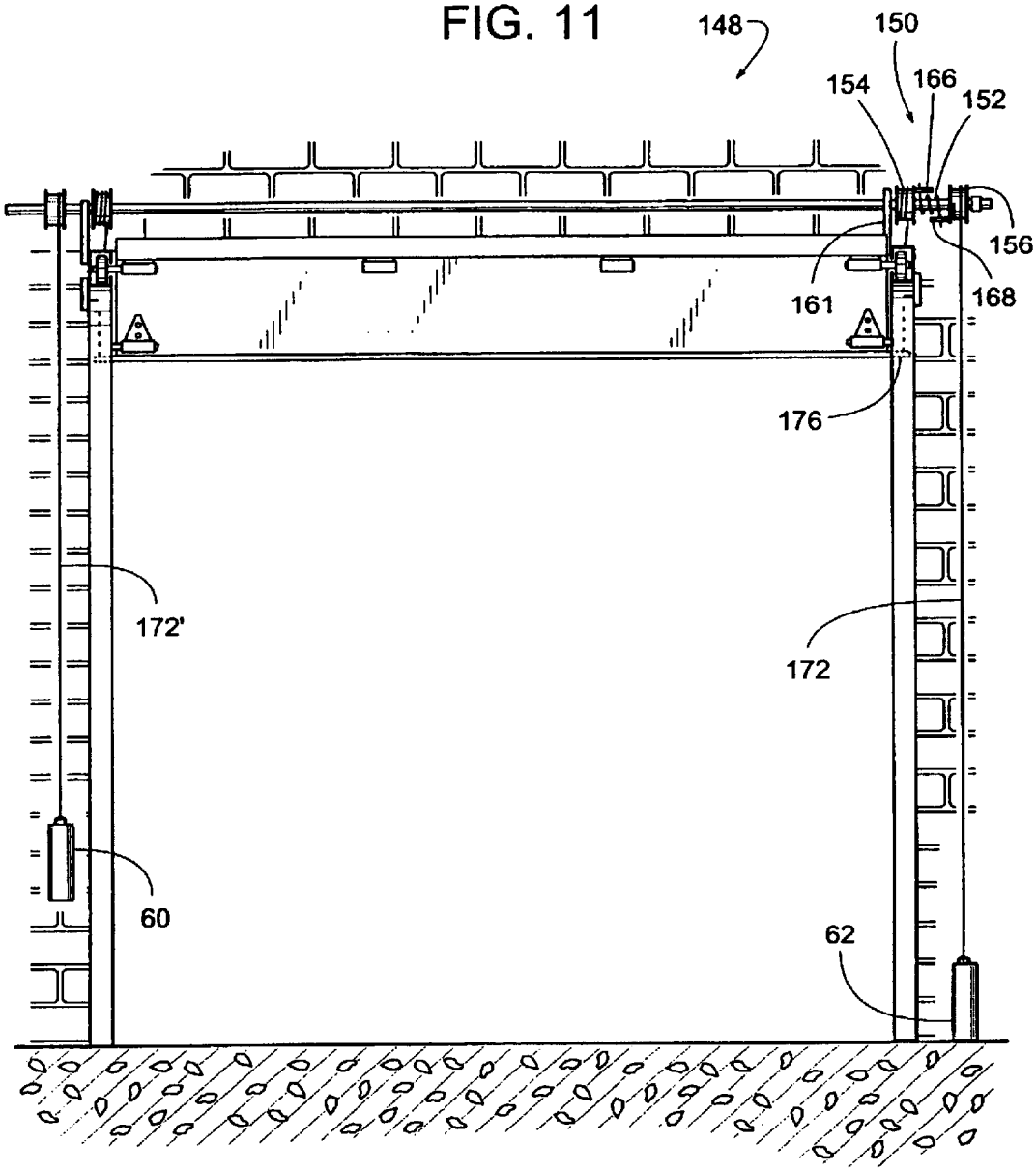
FIG. 11 is similar to FIG. 10, but with the door open.
Figure 12:
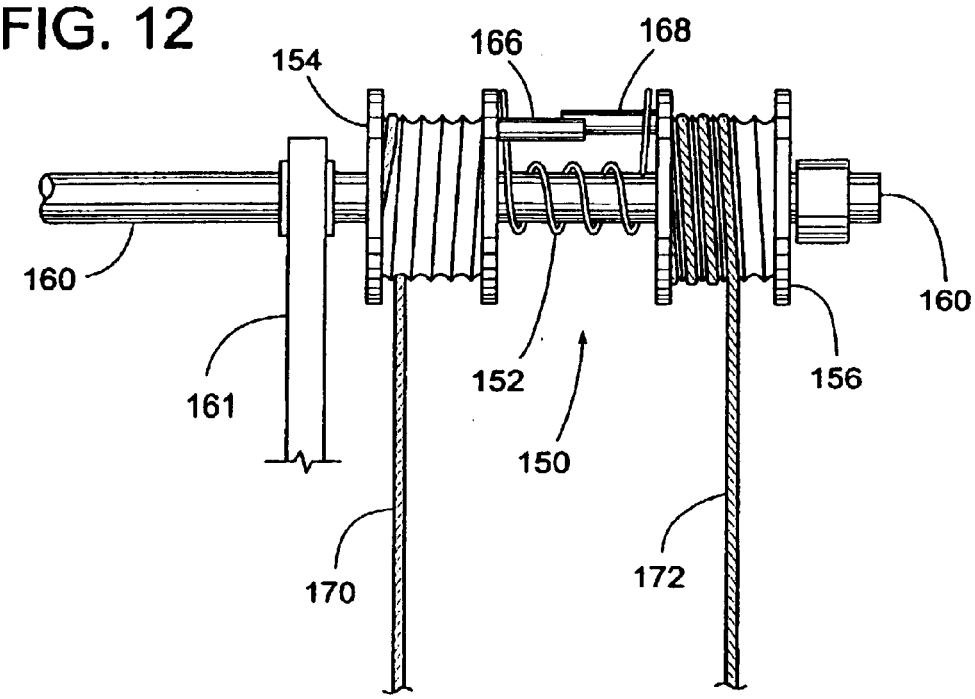
FIG. 12 is a close up view of the tensioner in the position shown in FIG. 10.
Figure 13:
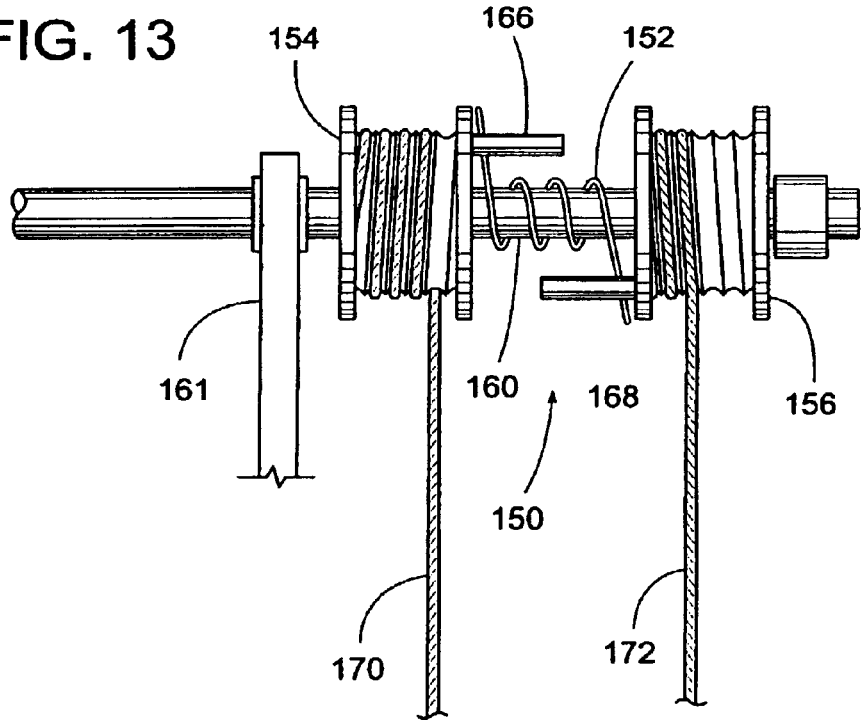
FIG. 13 is a close up view of the tensioner in the position shown in FIG. 11.

To help prevent cable slackness from allowing cable 172 to lift off of drum 156 or from allowing cable 170 to lift off drum 154, torsion spring 152 is installed around shaft 160 between drums 154 and 156. Opposite ends of spring 152 engage pins 166 and 168, as shown in FIGS. 12 and 13. Spring 152 urges drum 156 to rotate clockwise relative to drum 154 as viewed from the right of FIGS. 12 or 13. Under normal door operation, cables 170 and 172 will carry sufficient tension to overcome the urging of spring 152. So, pins 166 and 168 will normally remain engaged, as shown in FIGS. 10 and 12, and drums 154 and 156, together, will follow the rotation of shaft 160. In normal operation, then, tensioner 150 operates in the first mode. However, if the dynamic load or tension in cables 170 or 172 falls below a predetermined level, torsion spring 152 will be able to overcome that tension and rotate drum 156 a certain degree relative to drum 154, as shown in FIGS. 11 and 13. The relative rotation of the drums allows the drums to take up slack in their respective cables. Under such a condition, tensioner 150 operates in its second mode.

Figure 14:
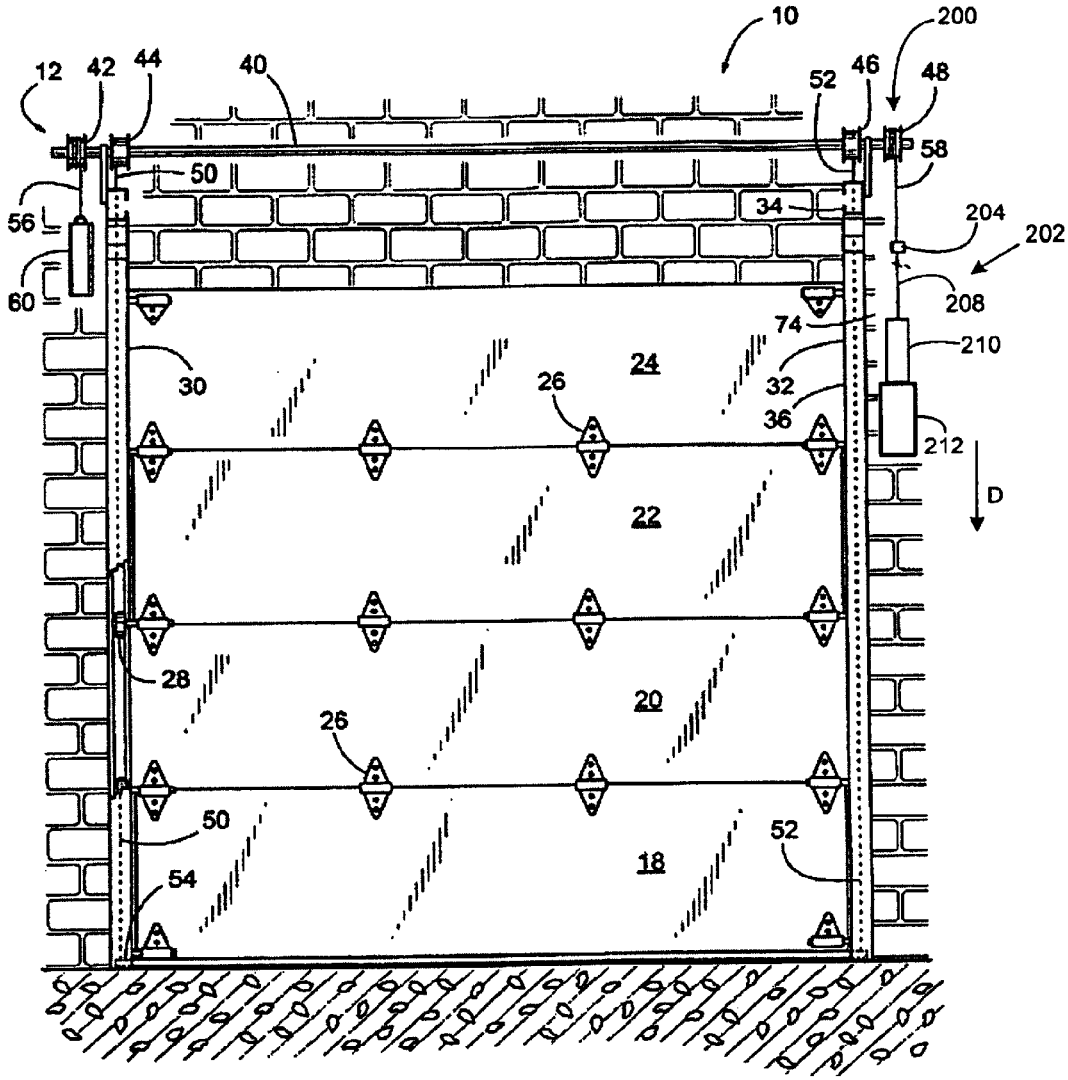
FIG. 14 is a front view of the sectional door of FIG. 1 in a closed position, as viewed from inside a building, and showing another tensioner in accordance with another example.
Figure 15:
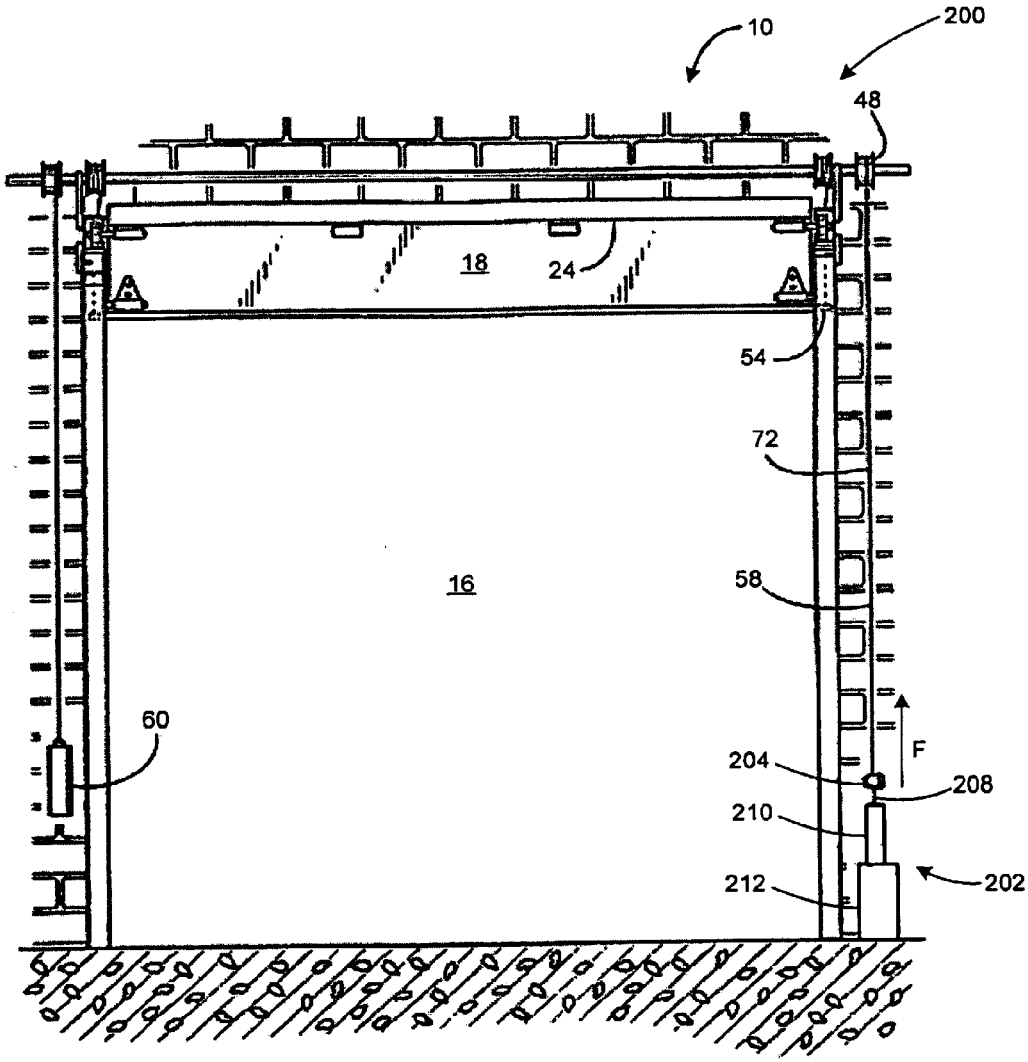
FIG. 15 is similar to FIG. 14 but with the door open.

FIGS. 14–15 illustrate an another example counterbalancing system that provides not only tensioning of a cable when operation would otherwise tend to put slack in the cable, but also provides shock absorption of excessive forces that tend to pull tightly on the cable, as might occur during a door or counterbalance freefall situation, as described herein.

FIG. 14 illustrates the sectional door 10 in an embodiment employing a counterbalance system 200 in place of the counterbalance system 12. The apparatus illustrated in FIG. 14 has similar structure to that of FIG. 1 and, therefore, like reference numerals are used. The system 200 helps counterbalance at least some of the weight of the door 10. The system 200 includes a tensioner 202 that is coupled to the cable 58 via a connector end 204, which may be a screw connection, a looped connection, a fastener, or a weld point, for example. The tensioner 202 is movable relative to the cable 58 to keep the cable 58 taught during a situation where there is the potential for slack in the cable 58. The tensioner 202 may maintain or increase the amount of tension in the cable 58.

To controllably tighten the cable 58 during such a slacking situation, and thereby preventing the cable 58 from falling off the drum 48, the tensioner 202 includes a moveable rod 208 that extends into a housing 210. The rod 208 is movable into and out of the housing 210 to compensate for a potential or actual decrease in tension in the cable 58. The rod 208 is biased into the housing 210 to compensate for the slacking situation. FIG. 14 shows a first position, wherein the rod 208 is fully extended out of the housing 210 due to the weight of a deadweight 212 connected to the housing 210.

The rod 208 may be a rigid member. However, the rod 208 may be any suitable type of linkage, such as a chain, a flexible member like a cable, or a spring. The deadweight 212, which in the position of FIG. 14 supplies a downward force that results in the rod 208 extending out of the housing 210, may be mounted to the housing 210 through a fastener, a weld, or a screw mount, for example.

FIG. 15 shows the tensioner 202 in a fully lowered position, where the door 10 has fully raised and the tensioner 202 has come to rest on a floor. In this position, any slack in the cable 58 is taken-up by the rod 208, which being biased into the housing 210 pulls back into the housing 210, thereby keeping the cable 58 in tension. Controlling the biasing position and force applied on the rod 208 may determine the amount of tension imparted by the tensioner 202.

Figure 16:
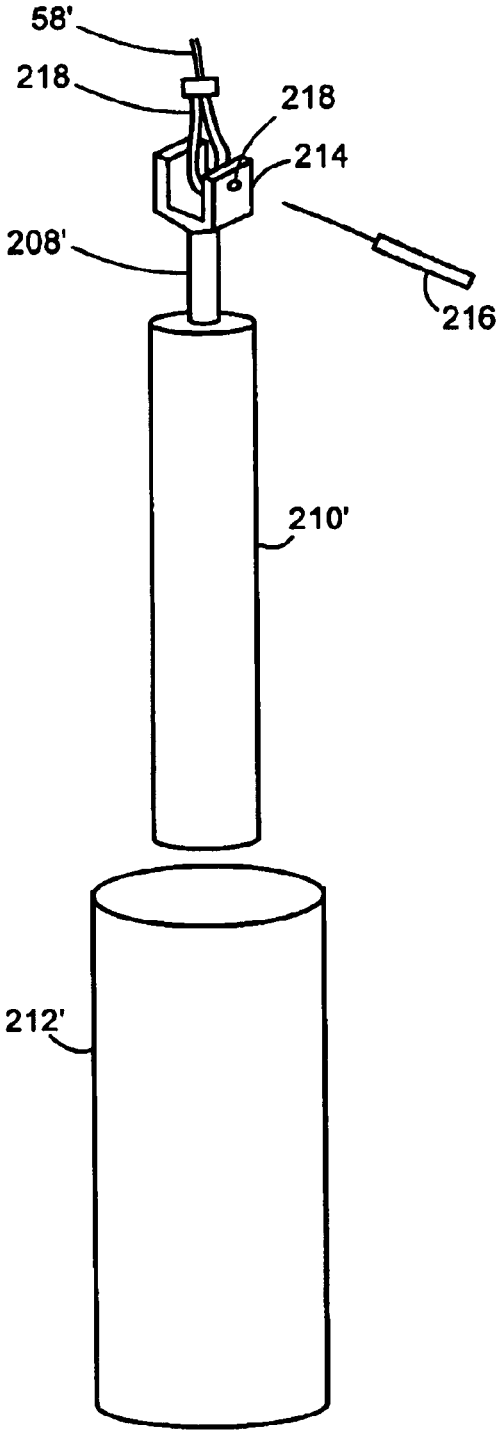
FIG. 16 illustrates a tensioner that maybe used with the sectional door of FIGS. 14 and 15 and has a housing and a deadweight.

FIG. 16 illustrates an example tensioner 202' in a partially unassembled form. A rod 208' is threaded into a housing 210', which is to be mounted to a deadweight 212' at an opposite end. The rod 208' is fastened to a connector head 214, which may receive a pin or screw 216 through a hole 218 to latch a loop 218 formed in a cable 58'. The tensioners 202 and 202' may each include a shock absorber for, at least partially, resisting a reaction force F (see, FIG. 15) or a reaction force D (see, FIG. 14) that may occur during operation, as explained in further detail below.

Figure 17:
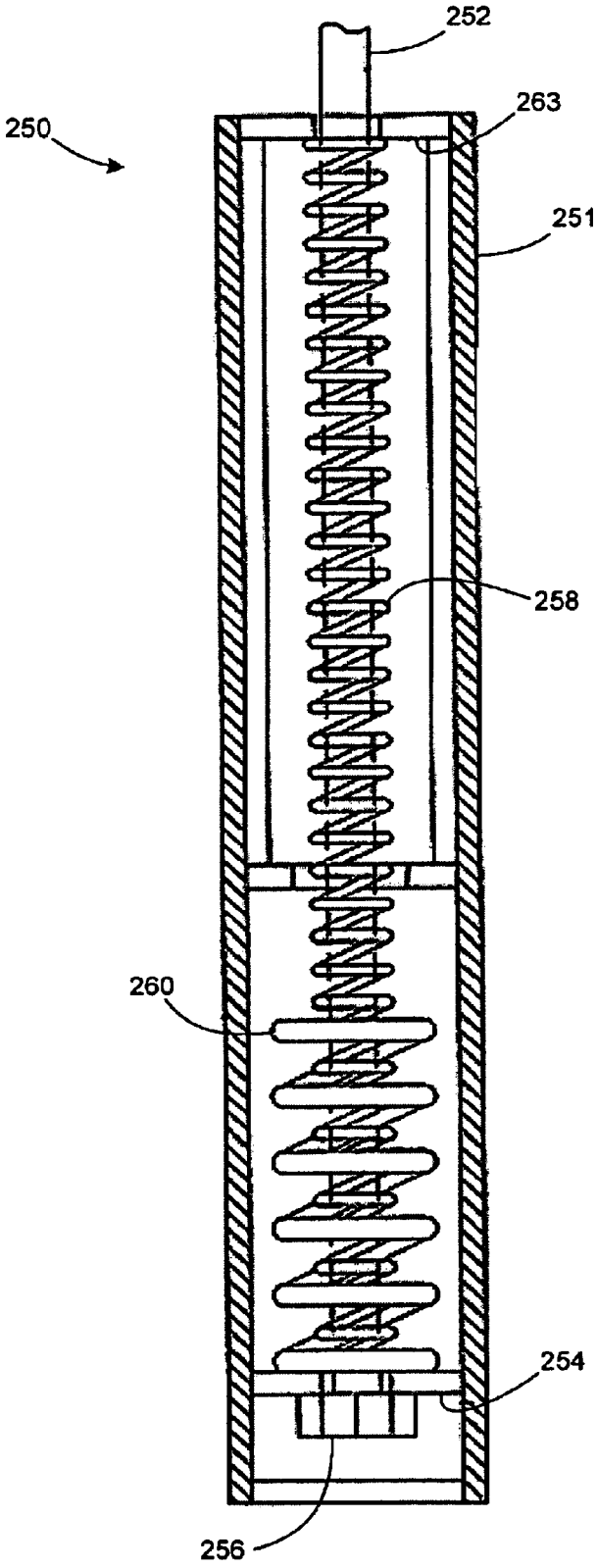
FIGS. 17–19 illustrate various positions of an apparatus including a tensioner in the form of a first resilient member and a shock absorber in the form of a second resilient member, in accordance with an example.
Figure 18:
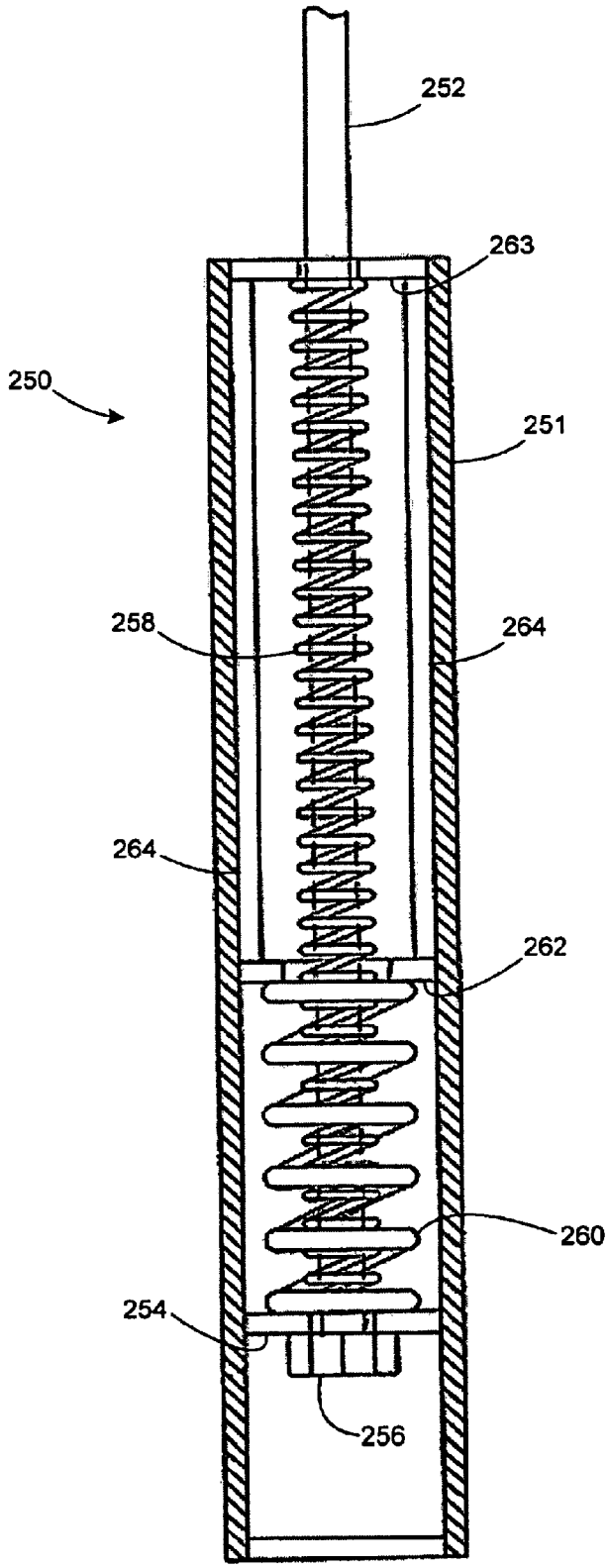
Figure 19:
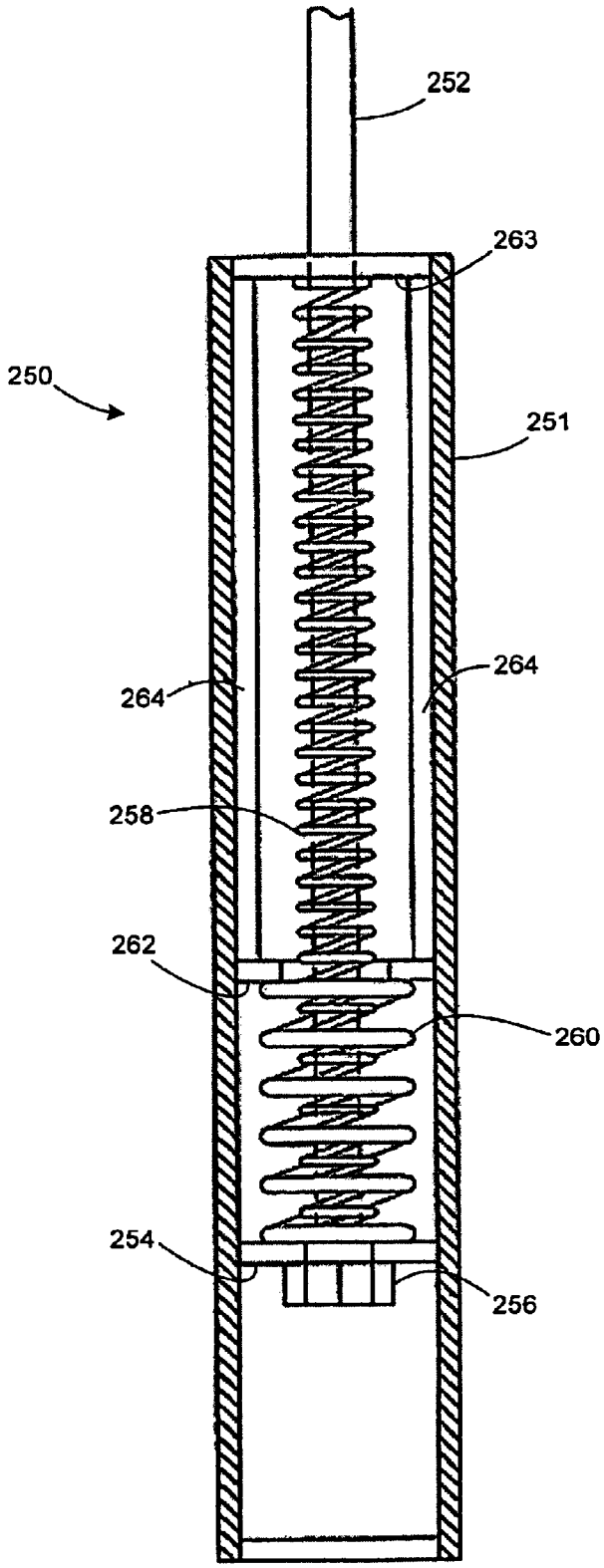

A cross-section of an apparatus 250 having a housing 251 that may be used as the housing 210 or 210' is illustrated in various positions in FIGS. 17–19. The housing 251 has an opening for receiving a rod 252, that may correspond to the rods 208 or 208'. The rod extends into the housing and is capped by a washer 254 and a bolt 256. The housing 251 includes a tensioning member in the form of a first resilient member 258, e.g., a spring in the illustrated example. The housing 251 further includes a shock absorbing member in the form of a second resilient member 260, also a spring in the illustrated example. The resilient members 258 and 260 are illustrated as compression springs, however, either or both may be replaced with tension springs, torsion springs, gas springs, an elastic member, or a compressible foam or rubber, for example.

The spring 260 encases the spring 258, which in turn encases the rod 252. In the illustrated example, the spring 260 has a shorter length than the spring 258. By way of example only, the spring 260 and the spring 258 may have an approximately 1:4 length ratio, for example, 5" length and a 22" length, respectively. Additionally, in the illustrated example, the spring 260 is formed of a heavier wire gauge than the spring 258 and has a higher spring rate. Both springs 258 and 260 abut against the washer 254 in the position illustrated in FIG. 17, where the spring 258 is in an active position capable of compression and the spring 260 is in a non-active position from which it does not compress.

To prevent damage to the cable (not shown), the rod 252, or the tensioning spring 258, the spring 260 is a shock absorbing member that will resist a reaction force pulling up on the rod 252. FIG. 18 shows a second position of the apparatus 250 wherein the rod 252 has been pulled, at least partially, out of the housing 250 to place the spring 260 in an active position. The position of the apparatus 250 shown in FIG. 18 may occur from a reaction force pulling up on the rod 252, as might occur with the door 10 of FIG. 15, where a force, F, has pulled upward on a counterweight. The force, F, may result from a rapid door ascent and subsequent freefall or any rapid pulling on the door downward. And, generally, the force, F, is sufficient to overcome a tensioning force imparted by the spring 258. Instead of the force, F, pulling on the rod 252, the position of FIG. 18 may also result from a downward force, D, pulling on the deadweight 212 and housing 251, similar to that shown in FIG. 14. The downward force may result from a freefall of the apparatus 250 or from a rapid ascent on the door 10. FIGS. 18 and 19 will, nevertheless, be described with reference to the force, F, pulling on the rod 252.

The force, F, has pulled the rod 252 and the washer 254, such that now the spring 260 is also abutting a second washer 262. The washer 262 is held in place by a spacer 264 that extends from the washer 262 to an upper end 263 of the housing 251. The spacer 264 may be a cylinder or rod or it may be removed entirely and replaced with a weld mount or other structure for substantially restraining the washer 262 against movement. The spacer 264 separates the end 263, which operates as a fixed support for the spring 258, from the washer 262, which operates as a fixed support for the spring 260. The washer 254 acts a third support movable relative to these two supports 263 and 262.

In the position illustrated in FIG. 18, the spring 258 has been compressed from the position of FIG. 17, thereby allowing the rod 252 to extend out of the housing 250. The spring 260, however, is not compressed.

The apparatus 250 is shown in a third position in FIG. 19, wherein the spring 260 has been compressed between washers 262 and 254 by the upward force, F. The spring 260, having a shorter length and higher spring rate than the spring the 258, prevents the force F from compressing the spring 258 far enough to deform it or damage it. The spring 260 may have a spring force sufficient to prevent the transfer of the force, F, to the spring 258 entirely or a spring force sufficient to limit the amount of force, F, transferred to the spring 258. In the illustrated example, the shock absorber 260 may absorb a force greater than the tensioning force of FIGS. 17 and 18.

Although the invention is described with reference to certain embodiments, it should be appreciated by those skilled in the art that various modifications are well within the scope of the invention. For example, the various disclosed tensioners and shock absorbers may be coupled to one or more of the cables leading to a deadweight and/or a door panel, and may be installed at locations other than those illustrated in the examples. And tensioners and shock absorbers described and illustrated with reference to a particular style of door are not necessarily limited to such a door, but rather may be readily adapted for use on other doors including, but not limited to sectional doors, roll-up doors, high-lift doors, horizontally storing doors, vertically storing doors, and various combinations thereof. For example, for roller doors like that shown in FIG. 5, the counterbalance system is often a counterweight system with the cable drums being mounted on the same shaft 84 as roll tube 82. For embodiments that include a deadweight, the quantity of deadweights can be less or significantly more than the quantities shown and described. Moreover, the shape, size and location of the deadweights may vary significantly and still remain well within the scope of the invention.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalence.

What is claimed is:

1. A door comprising:

a door panel;

a counterbalance system including a flexible elongated member; and a tensioner coupled to the counterbalance system and adapted to apply a tensioning force to prevent slack in the flexible elongated member, the tensioner comprising:

a shock absorber coupled to the counterbalance system to absorb a reaction force greater than the tensioning force, wherein the shock absorber includes a first resilient member; and a second resilient member.

2. The door of claim 1, wherein the first resilient member is more resilient than the second resilient member.

3. The door of claim 1, wherein the first resilient member is moveable relative to the second resilient member.

4. A door comprising:

a door panel;

a counterbalance system including a flexible elongated member; and a tensioner coupled to the counterbalance system and adapted to apply a tensioning force to prevent slack in the flexible elongated member, the tensioner comprising:

a shock absorber coupled to the counterbalance system to absorb a reaction force greater than the tensioning force; and wherein the tensioner includes a resilient a member adapted to take up the slack in the flexible elongated member, the door further comprising:

a first support coupled to the shock absorber; and a second support coupled to the resilient member.

5. The door of claim 4, wherein the first support is spaced from the second support.

6. The door of claim 4, further comprising a housing enclosing the resilient member, the shock absorber, the first support and the second support, wherein the resilient member has a longer length than the shock absorber.

7. The door of claim 4, further comprising a third support coupled to the resilient member and the shock absorber and moveable relative to the first support and the second support.

8. A door comprising:

a door panel;

a counterbalance system including a flexible elongated member; and a tensioner coupled to the counterbalance system and adapted to apply a tensioning force to prevent slack in the flexible elongated member, the tensioner comprising:

a shock absorber coupled to the counterbalance system to absorb a reaction force greater than the tensioning force; and a tension spring.

9. A door comprising:

a door panel;

a counterbalance system including a flexible elongated member; and a tensioner coupled to the counterbalance system and adapted to apply a tensioning force to prevent slack in the flexible elongated member, the tensioner comprising:

a shock absorber coupled to the counterbalance system to absorb a reaction force greater than the tensioning force; and a compression spring.

10. A door comprising:

a door panel;

a counterbalance system including a flexible elongated member; and a tensioner coupled to the counterbalance system and adapted to apply a tensioning force to prevent slack in the flexible elongated member, the tensioner comprising:

a shock absorber coupled to the counterbalance system to absorb a reaction force greater than the tensioning force; and a torsion spring.

11. A method of counterbalancing a door comprising:

providing a door panel that is movable between a first position and a second position;

coupling a flexible elongated member to the door panel;

coupling a deadweight to the flexible elongated member so that the deadweight moves downward in response to the door panel moving from the first position to the second position;

applying a tensioning force to prevent slack in the flexible elongated member by coupling a tensioner comprising a first resilient member between a portion of the flexible elongated member and the deadweight; and in response to a reaction force overcoming the tensioning force, countering the reaction force to prevent a predetermined amount of force from transferring to the flexible elongated member by coupling a shock absorber between the flexible elongated member and the deadweight.

12. The method of claim 11, wherein the shock absorber comprises a second resilient member.

13. The method of claim 12, wherein the first resilient member has a first resiliency different than a second resiliency of the second resilient member.

14. The method of claim 12, wherein the second resilient member is a tension spring.

15. The method of claim 12, wherein the second resilient member is a compression spring.

16. The method of claim 12, wherein the second resilient member is movable between a non-active state and an active state.

* * * * *